US011121512B2

(12) United States Patent
Zhang et al.

(10) Patent No.: US 11,121,512 B2
(45) Date of Patent: Sep. 14, 2021

(54) ELECTRICAL CONNECTOR WITH PARTIALLY OVERLAPPED AND STAGGERED CONTACT ARMS

(71) Applicant: Drapho Electronics Technology.,Ltd, Kunshan (CN)

(72) Inventors: Ming Zhang, Kunshan (CN); Hongjiang Yao, Kunshan (CN); Zhihong Fang, Kunshan (CN)

(73) Assignee: Drapho Electronics Technology., Ltd, Kunshan (CN)

( * ) Notice: Subject to any disclaimer, the term of this patent is extended or adjusted under 35 U.S.C. 154(b) by 0 days.

(21) Appl. No.: 16/930,970

(22) Filed: Jul. 16, 2020

(65) Prior Publication Data

US 2021/0135410 A1 May 6, 2021

(30) Foreign Application Priority Data

Oct. 31, 2019 (CN) ..... 201911056978.9

(51) Int. Cl.

| | |
|---|---|
| ***H01R 24/60*** | (2011.01) |
| ***H01R 13/24*** | (2006.01) |
| ***H01R 13/40*** | (2006.01) |
| ***H01R 13/6581*** | (2011.01) |
| ***H01R 13/6591*** | (2011.01) |

(52) U.S. Cl.

CPC ..... *H01R 24/60* (2013.01); *H01R 13/24* (2013.01); *H01R 13/40* (2013.01); *H01R 13/6581* (2013.01); *H01R 13/6591* (2013.01)

(58) Field of Classification Search

CPC ..... H01R 12/55; H01R 12/57; H01R 13/02; H01R 13/24; H01R 13/40; H01R 13/6581; H01R 13/6591; H01R 24/60

See application file for complete search history.

(56) References Cited

U.S. PATENT DOCUMENTS

| | | | | |
|---|---|---|---|---|
| 10,236,638 | B2 * | 3/2019 | Kong | H01R 13/6582 |
| 2016/0359256 | A1 * | 12/2016 | Zhang | H01R 13/405 |
| 2017/0133797 | A1 * | 5/2017 | Guo | H01R 24/62 |
| 2017/0294753 | A1 * | 10/2017 | Wu | H01R 13/405 |
| 2019/0348785 | A1 * | 11/2019 | Tsai | H01R 13/08 |

(Continued)

FOREIGN PATENT DOCUMENTS

| | | |
|---|---|---|
| CN | 203250876 U | 10/2013 |
| CN | 204179281 U | 2/2015 |

(Continued)

*Primary Examiner* — Oscar C Jimenez

(74) *Attorney, Agent, or Firm* — Andrus Intellectual Property Law, LLP

(57) ABSTRACT

Provided is an electrical connector. The electrical connector includes an insulation body, and a terminal group received in the insulation body. The terminal group includes upper-row terminals and lower-row terminals. The upper-row terminals and the lower-row terminals are equal in quantity and are arranged in one-to-one correspondence in a vertical direction. Each of the upper-row terminals is provided with an upper contacting arm extending in a horizontal direction, and each of the lower-row terminals is provided with a lower contacting arm extending in the horizontal direction. The upper contacting arm and the corresponding lower contacting arm partially overlap and partially stagger in the vertical direction.

8 Claims, 7 Drawing Sheets

(56) References Cited

U.S. PATENT DOCUMENTS

| | | | | |
|---|---|---|---|---|
| 2021/0013689 | A1* | 1/2021 | Sakoda | H01R 43/24 |
| 2021/0066874 | A1* | 3/2021 | Sakaizawa | H01R 13/6586 |
| 2021/0135411 | A1* | 5/2021 | Mao | H01R 13/24 |

FOREIGN PATENT DOCUMENTS

| | | | |
|---|---|---|---|
| CN | 204516944 | U | 7/2015 |
| CN | 204516945 | U | 7/2015 |
| CN | 207038844 | U | 2/2018 |
| CN | 208723143 | U | 4/2019 |
| CN | 208723159 | U | 4/2019 |
| CN | 209298476 | U | 8/2019 |
| CN | 209963309 | U | 1/2020 |
| CN | 110867700 | A | 3/2020 |

* cited by examiner

ELECTRICAL CONNECTOR WITH PARTIALLY OVERLAPPED AND STAGGERED CONTACT ARMS

CROSS-REFERENCES TO RELATED APPLICATIONS

This application claims priority to a Chinese patent application No. CN201911056978.9 filed on Oct. 31, 2019, the entire contents of which are incorporated herein by reference.

TECHNICAL FIELD

This application relates to the electrical connector field.

BACKGROUND

An existing Type C USB connector generally includes an insulation body and upper-row terminals and lower-row terminals fixed to the insulation body. The number of the upper-row terminals is equal to the number of the lower-row terminals, and the upper-row terminals and the lower-row terminals are arranged in one-to-one correspondence. The upper-row terminal and the lower-row terminal overlap in the vertical direction. Due to such a structure design, the manufacturing process of the connector is relatively complicated and cannot be formed through integral injection molding and sealing. The upper-row terminals and the lower-row terminals need to be subjected to injection and molding respectively to form semi-finished products, and then the semi-finished products are assembled to the final product. This manufacturing process is cumbersome. In addition, the design of complete overlapping of the upper-row terminals and the lower-row terminals may also adversely affect the high-quality transmission of a signal and easily affect the transmission quality of the signal.

SUMMARY

A technical problem solved by the present disclosure is to provide an electrical connector assembly to improve at least one of a problem of poor signal transmission quality of a terminal or a complicated process problem in the related art.

To solve the above problems, the present disclosure adopts the following technical solutions. An electrical connector includes an insulation body and a terminal group received in the insulation body. The terminal group includes upper-row terminals and lower-row terminals. The upper-row terminals and the lower-row terminals are equal in quantity and are arranged in one-to-one correspondence in a vertical direction. Each of the upper-row terminals is provided with an upper contacting arm extending in a horizontal direction, and each of the lower-row terminals is provided with a lower contacting arm extending in the horizontal direction. The upper contacting arm and the corresponding lower contacting arm partially overlap and partially stagger in the vertical direction.

In one or more embodiments, the upper contacting arm extends in a rear-to-front direction and is provided with an upper main arm and an upper offset arm, the upper offset arm extends forwardly from a front end of the upper main arm, the lower contacting arm extends in the rear-to-front direction and is provided with a lower main arm and a lower offset arm, and the lower offset arm extends forwardly from a front end of the lower main arm.

In one or more embodiments, the upper main arm and the lower main arm are arranged in a stagger way in the vertical direction, such that a projection of the upper main arm and a projection of the lower main arm do not overlap.

In one or more embodiments, the upper offset arm extends from the front end of the upper main arm at an offset in a first direction and the lower offset arm extends from the front end of the lower main arm at an offset in a second direction opposite to the first direction, such that a projection of the upper offset arm and a projection of the lower offset arm coincide in the vertical direction.

In one or more embodiments, a front end of the upper contacting arm is provided with a bending upper embedded part, a front end of the lower contacting arm is provided with a bending lower embedded part, and the upper embedded part and the lower embedded part are embedded in the insulation body respectively.

In one or more embodiments, the upper embedded part is provided with an upper limit arm slanted leftward, the lower embedded part is provided with a lower limit arm slanted rightward, and the upper limit arm and the lower limit arm are arranged in a stagger way in the vertical direction.

In one or more embodiments, the upper embedded part is bent downwardly from the front end of the upper contacting arm, and the lower embedded part is bent upwardly from the front end of the lower contacting arm.

In one or more embodiments, the electrical connector further includes an isolation plate between the upper-row terminals and lower-row terminals. The isolation plate includes a pair of upper grounding arms and a pair of lower grounding arms, and the pair of upper grounding arms and the pair of lower grounding arms are integrally connected with the isolation plate. The pair of upper grounding arms and the upper-row terminals are arranged in a same plane, and the pair of upper grounding arms is on two sides of the upper-row terminals respectively. The pair of lower grounding arms and the lower-row terminals are arranged in a same plane, and the pair of lower grounding arms is on two sides of the lower-row terminals respectively.

In one or more embodiments, the pair of upper grounding arms is formed on the isolation plate in a tearing forming manner, two ends of each of the pair of upper grounding arms are integrally connected with the isolation plate, and the pair of lower grounding arms corresponds to the pair of upper grounding arms in the vertical direction.

Compared with the related art, the structure of the upper-row terminals and lower-row terminals is optimized in such a manner that they partially overlap and partially stagger in the vertical direction, in particular, they coincide in the vertical direction in an electrical contact region and stagger in the vertical direction in a non-contact region. Such a design is helpful for the manufactory process, the upper-row terminals, the lower-row terminals, and the isolation plate are assembled and then subjected to overall injection and molding, simplifying the manufactory process and reducing the manufactory cost.

DETAILED DESCRIPTION

Please referring to FIG. 1 through FIG. 7, an electrical connector is provided in the present disclosure. The electrical connector includes an insulation body 10, a terminal group 20 and an isolation plate 30 received in the insulation body 10, and a housing 40 coating a surface of the insulation body 10. The terminal group 20 and the isolation plate 30 are fixed inside the insulation body 10 and are used for a stable signal transmission. The housing 40 is used for shielding external interference signals and also provides a protection function for the insulation body 10. A specific structure and function of each part are described below in details.

Figure 1:
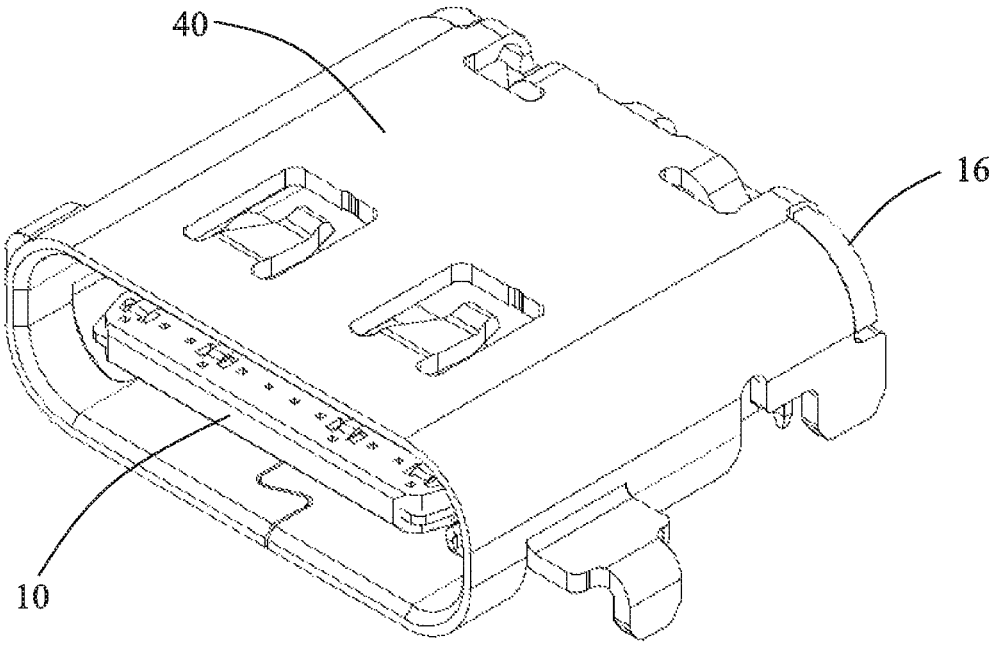
FIG. 1 is a perspective view of an electrical connector according to the present disclosure.
Figure 2:
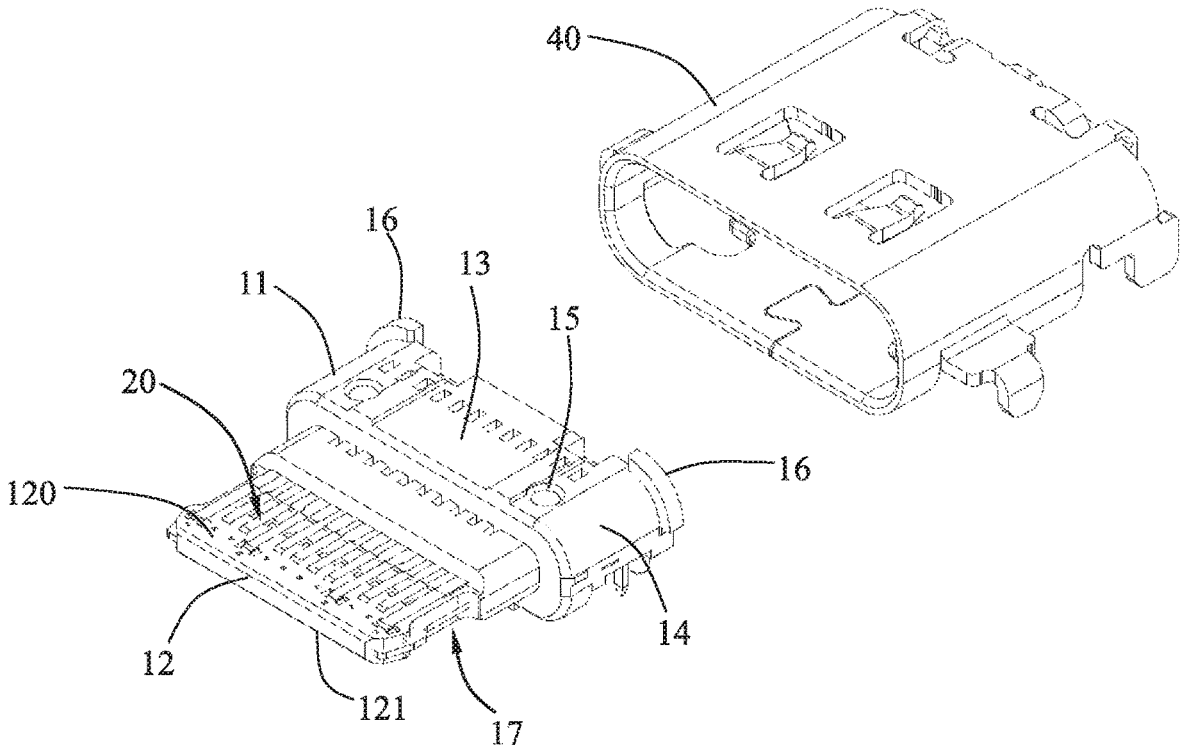
FIG. 2 is an exploded view of a part of the electrical connector according to the present disclosure.
Figure 3:
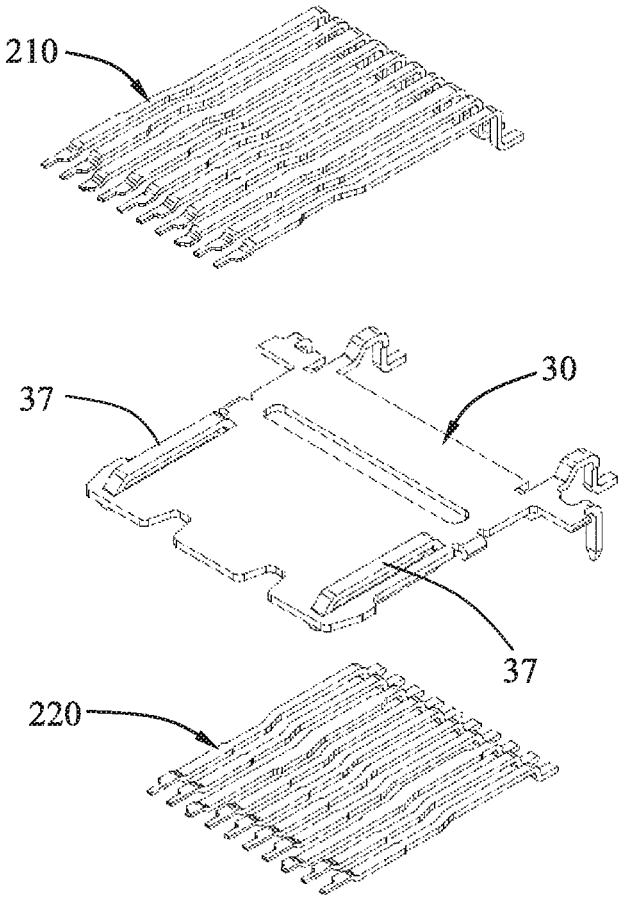
FIG. 3 is a schematic view of upper-row terminals and lower-row terminals of the electrical connector according to the present disclosure.

As shown in FIG. 1 and FIG. 2, the insulation body 10 includes a base part 11 and a docking tongue plate 12 that extends forwardly from the base part 11. Two sides of the base part 11 are provided with a top surface 13 and a pair of arcuate wall surfaces 14 located on two sides of the top surface 13 respectively. The top surface 13 includes grooves 15 for positioning with the housing 40 in an engaged manner. The pair of arcuate wall surfaces 14 is used for assembling with the housing 40 in an attached manner. In addition, a stopper 16 protruding upwardly is provided on a rear side of the top surface 13. The stopper 16 abuts against the housing 40 from the rear to realize a front-rear direction limitation. The docking tongue plate 12 has a top surface 120 and a bottom surface 121, and is configured to support the terminal group 20. Furthermore, recessed parts 17 recessed inwardly are provided on two sides of the docking tongue plate 12.

Figure 6:
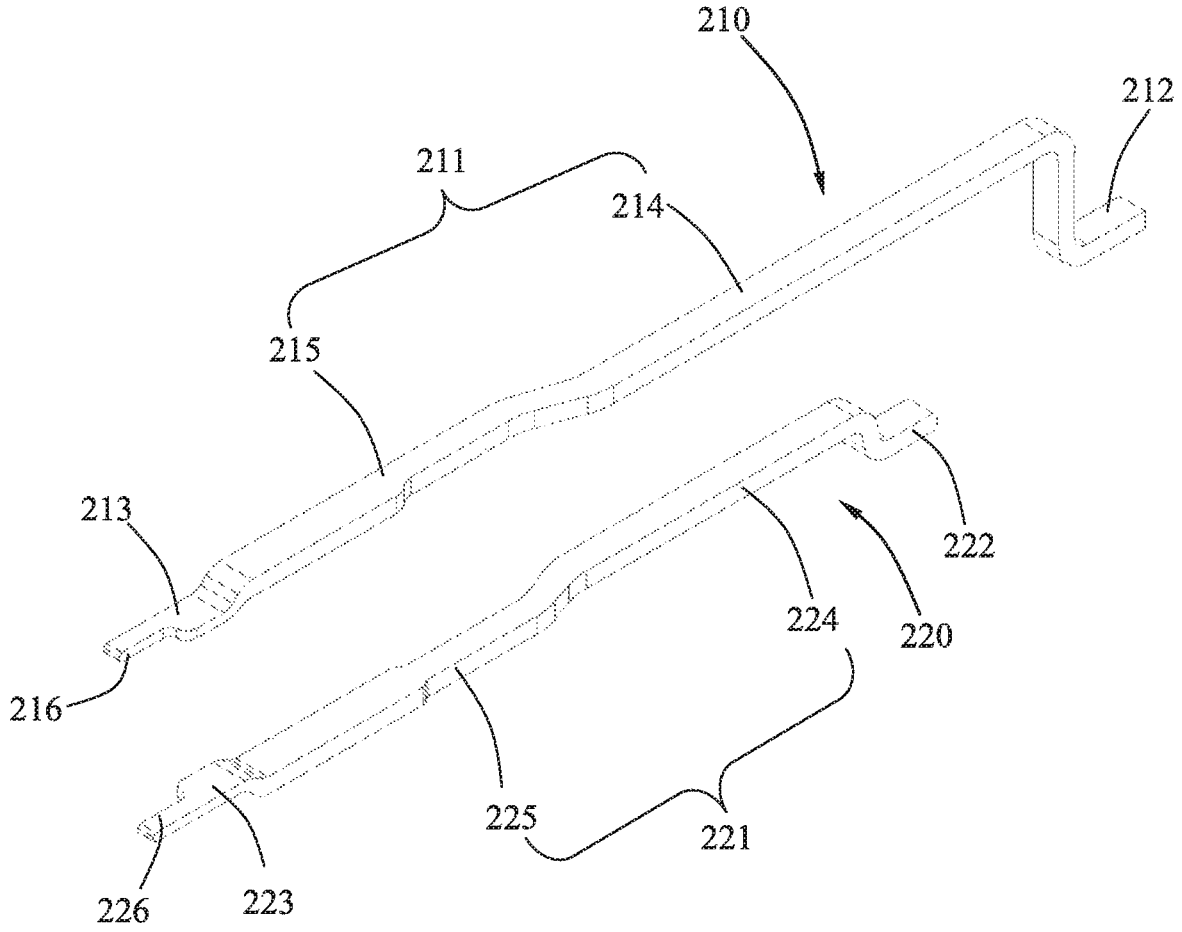
FIG. 6 is a schematic view of a signal upper-row terminal and a single lower-row terminal of the electrical connector according to the present disclosure.

As shown in FIG. 2 and FIG. 6, the terminal group 20 includes upper-row terminals 210 and lower-row terminals 220. A number of the upper-row terminals 210 is equal to a number of the lower-row terminals 220. The upper-row terminals 210 and the lower-row terminals 220 are arranged in one-to-one correspondence in a vertical direction. The upper-row terminals 210 are disposed on the top surface 120 of the docking tongue plate 12, and the lower-row terminals 220 are disposed on the bottom surface 121 of the docking tongue plate 12. Each of the upper-row terminals 210 is provided with an upper contacting arm 211 exposed to the top surface 120 of the docking tongue plate 12 and an L-shaped upper mounting arm 212 extending from a rear end of the upper contacting arm 211. The upper contacting arm 211 extends from rear to front, and an upper embedded part 213 is provided at a front end of the upper contacting arm 211. The upper embedded part 213 is configured to be embedded in the docking tongue plate 12. Each of the lower-row terminals 220 is provided with a lower contacting arm 221 exposed to the bottom surface 121 of the docking tongue plate 12 and a lower mounting arm 222 extending from a rear end of the lower contacting arm 221. The lower contacting arm 221 extends from rear to front, and a lower embedded part 223 is provided at a front end of the lower contacting arm 221.

It is noted that in the one or more embodiments of the present disclosure, the upper contacting arm 211 includes an upper main arm 214 and an upper offset arm 215 extending forwardly from a front end of the upper main arm 214, the upper offset arm 215 and the upper main arm 214 are of an integral structure, but the upper offset arm 215 is arranged offset with respect to the upper main arm 214 in a horizontal plane; the lower contacting arm 221 includes a lower main arm 224 and a lower offset arm 225 extending forwardly from a front end of the lower main arm 224, the lower offset arm 225 and the lower main arm 224 are of an integral structure, and the lower offset arm 225 is arranged offset with respect to the lower main arm 224 in the horizontal plane. It should be noted that the upper main arm 214 is secured at an upper side of the docking tongue plate 12, the lower main arm 224 is secured at a lower side of the docking tongue plate 12, and the upper main arm 214 and the lower main arm 224 are arranged in a stagger manner in the vertical direction, such that a projection of the upper main arm 214 and a projection of the lower main arm 224 do not overlap. The upper offset arm 215 is arranged offset in a first direction from the front end of the upper main arm 214, and the lower offset arm 225 is arranged offset in a second direction from the front end of the lower main arm 224 where the second direction is opposite to the first direction, such that in the vertical direction, a projection of the upper offset arm 215 and a projection of the lower offset arm 225 coincide. That is, the upper main arm 214 of the upper-row terminal 210 and the lower main arm 224 of the lower-row terminal 220 corresponding to the upper-row terminal 210 are arranged in a stagger manner in the vertical direction, and the projection of the upper main arm 214 and the projection of the lower main arm 224 do not overlap. The upper offset arm 215 of the upper-row terminal 210 extends forwardly from the front end of the upper main arm 214, the lower offset arm 225 of the lower-row terminal 220 extends forwardly from the front end of the lower main arm 224, and the upper offset arm 215 and the lower offset arm 225 are arranged close to each other in such a manner that in the vertical direction, the projection of the upper offset arm 215 and the projection of the lower offset arm 225 coincide.

Figure 7:
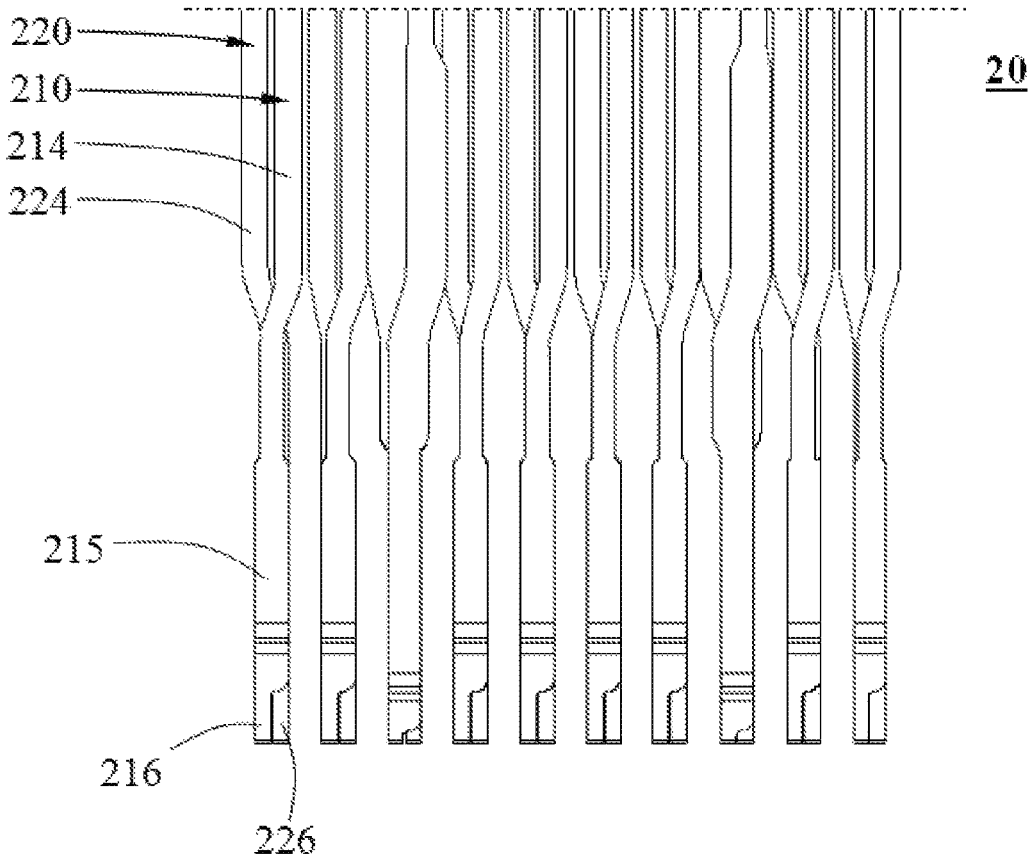
FIG. 7 is a schematic view illustrating an arrangement of upper-row terminals and lower-row terminals in an assembled state according to the present disclosure.

In addition, the upper embedded part 213 is bent downwardly from the front end of the upper contacting arm 211 and is embedded in the docking tongue plate 12, the lower embedded part 223 is bent upwardly from the front end of the lower contacting arm 221 and is embedded in the docking tongue plate 12, such that the terminals are fastened. It should be noted that in one or more embodiments of the present disclosure, the upper embedded part 213 is provided with an upper limit arm 216 slanted leftward, the lower embedded part 223 is provided with a lower limit arm 226 slanted rightward, such that as shown in FIG. 7, the upper limit arms 216 of the upper-row terminals 210 and the lower limit arms 226 of the lower-row terminals 220 are arranged in a stagger manner in the vertical direction.

For one upper-row terminal 210 and one lower-row terminal 220 corresponding the one upper-row terminal 210, some parts of the upper-row terminal 210 and some parts of the corresponding lower-row terminal 220 coincide in the vertical direction, while some parts of the upper-row terminal 210 and some parts of the corresponding lower-row terminal 220 are arranged in a stagger manner in the vertical direction. The upper offset arm 215 serves as the electrical contacting portion of the upper-row terminal 210 and the lower offset arm 225 serves as the electrical contacting portion of the lower-row terminal 220, and therefore, the overlapping of the upper offset arm 215 and the lower offset arm 225 in the vertical direction is more beneficial to the signal transmission. The upper mounting arm 212 serves as the mounting portion of the upper-row terminal 210, and the lower mounting arm 222 serves as the mounting portion of the lower-row terminal 220. The upper mounting arm 212 and the lower mounting arm 222 extend backwardly outside of the insulation body 10 and are configured to be soldered to a circuit board (not shown), and therefore, the staggering of the upper mounting arm 212 and the lower mounting arm 222 in the vertical direction is more beneficial to the mounting operation.

Figure 4:
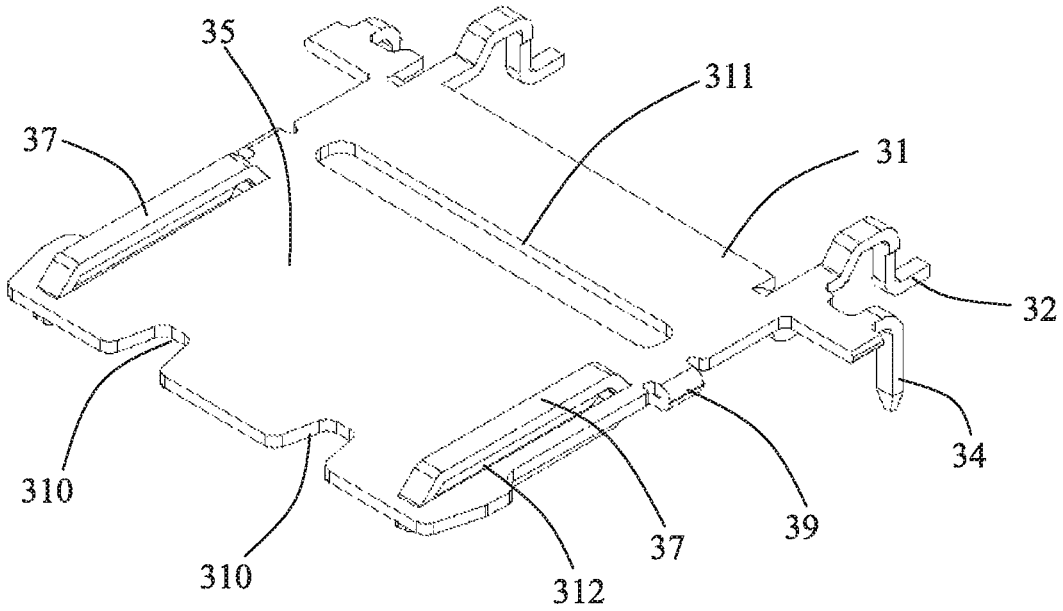
FIG. 4 is a perspective view of the electrical connector when a top surface of an isolation plate faces upwardly according to the present disclosure.
Figure 5:
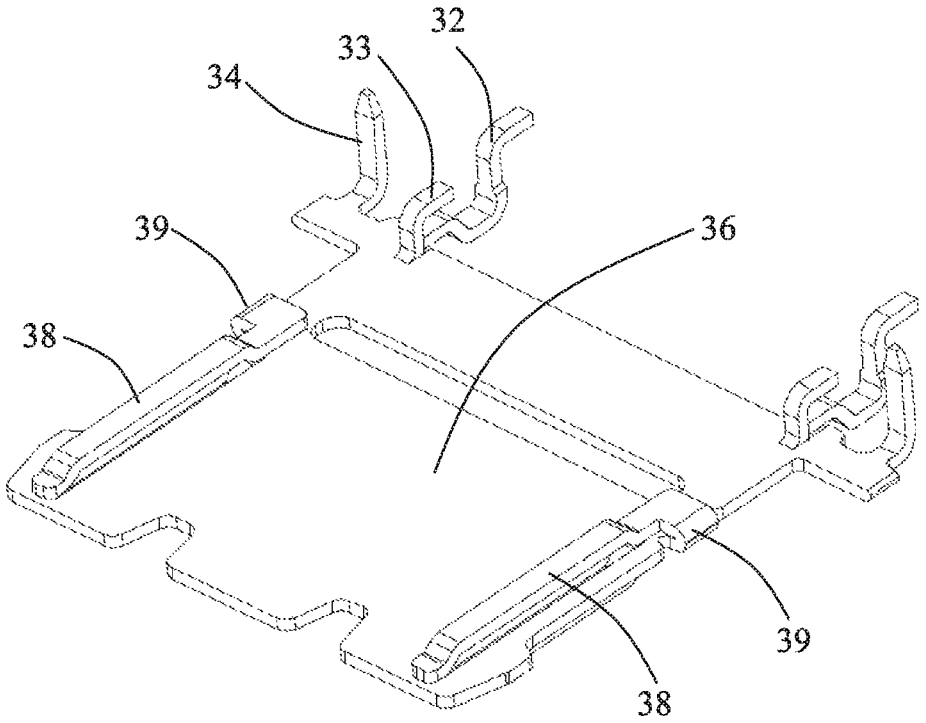
FIG. 5 is a perspective view of the electrical connector when a bottom surface of an isolation plate faces upwardly according to the present disclosure.

As shown in FIG. 4 and FIG. 5, the isolation plate 30 is embedded in the docking tongue plate 12 and is between the upper-row terminals 210 and the lower-row terminals 220, and the isolation plate 30 provides a separation function. The isolation plate 30 is made of metal and is formed through integrally stamping and bending metal material. The isolation plate 30 includes a base plate 31, a first mounting leg 32, a second mounting leg 33, and a third mounting leg 34, where the first mounting leg 32, the second mounting leg 33 and the third mounting leg 34 extend from a rear end of the base plate 31. The base plate 31 has a front surface 35 facing upwardly and a back surface 36 facing downwardly. The base plate 31 includes a pair of upper grounding arms 37 arranged on two sides of the front surface 35 respectively and a pair of lower grounding arms 38 bent downwardly from two side edges of the front surface 35 respectively. A pair of notches 310 recessed backwardly is provided at a front edge of the base plate 31. The base plate 31 is further provided with an elongated hole 311 which runs through the base plate 31 in the vertical direction, and the front surface 35 and the back surface 36 are communicated through the hole 311. Each of the pair of upper grounding arms 37 protrudes upwardly from front surface 35 and is in an elongated shape. The pair of upper grounding arms 37 extends from rear to front along two side edges of the base plate 31 respectively. The pair of lower grounding arms 38 is below the base plate 31. Each of the pair of lower grounding arms 38 is integrally connected with the base plate 31 via a U-shaped bending arm 39. The pair of lower grounding arms 38 is in an elongated shape and extends from rear to front. The first mounting legs 32 and the second mounting legs 33 extend from the rear edge of the base plate 31 and are distributed in a front-rear direction. The first mounting legs 32 are on two sides of the upper-row terminals 210 respectively, and the second mounting legs 33 are on two sides of the lower-row terminals 220 respectively. The third mounting legs 34 are at exterior sides of the first mounting legs 32 and the second mounting legs 33 respectively. The third mounting legs 34 are directly inserted into a circuit board to realize electrical connection. In the front-rear direction, the third mounting legs 34 are between the first mounting legs 32 and the second mounting legs 33.

It should be noted that the pair of upper grounding arms 37 and the pair of lower grounding arms 38 are on the front side and the back side of the base plate 31 respectively, and the projection of the pair of upper grounding arms 37 in the vertical direction and the projection of the pair of lower grounding arms 38 in the vertical direction at least partially overlap. Furthermore, the upper grounding arm 37 is formed on the base plate 31 in a tearing forming manner, so both a front end and a rear end of the upper grounding arm 37 are integrally connected with the base plate 31. The base plate 31 has a slot 312 directly below the upper grounding arm 37, and the slot 312 is formed due to the tearing forming. The two upper grounding arms 37 extend parallel to each other. A front end of the lower grounding arm 38 is a free end. The front end of the lower grounding arm 38 is not integrally connected with the base plate 31, but is connected with the back surface 36 of the base plate 31 in a lap manner. A rear end of the lower grounding arm 38 is integrally connected with the U-shaped bending arm 39. The upper grounding arms 37 are at the front and end sides of the array of upper-row terminals 210, and are arranged to be parallel to the upper-row terminals 210. The lower grounding arms 38 are at the front and end sides of the array of lower-row terminals 220, and are arranged to be parallel to the lower-row terminals 220. In this way, the isolation plate 30 isolates the upper-row terminals 210 and the lower-row terminals 220. In addition, the isolation plate 30 is further provided with the upper grounding arms 37 exposed to the top surface 120 of the docking tongue plate 12 and the lower grounding arms 38 exposed to the bottom surface 121 of the docking tongue plate 12, so the isolation plate 30 serves as a grounding element of the upper-row terminals 210 and the lower-row terminals 220, which can improve the signal transmission. Furthermore, the upper grounding arms 37, the lower grounding arms 38, and the base plate 38 are in an integral structure, thereby ensuring the stability of the grounding connection and satisfying requirements of high-frequency transmission.

In view of the above, the present disclosure improves the structure of upper-row terminals and lower-row terminals, the upper-row terminals and lower-row terminals partially overlap and partially stagger in the vertical direction. In particular, they coincide in the vertical direction in the electrical contact region, while they stagger in the vertical direction in the non-contact region. Such a configuration is helpful for the manufactory process, the upper-row terminals, the lower-row terminals, and the isolation plate are assembled and then subjected to overall injection and molding, simplifying the manufactory process and reducing the manufactory cost.

The above description is only the exemplary embodiments of the present invention, and does not limit the present invention in any form. Any possible variations and modifications made by those skilled in the art by using the method and content disclosed above without departing from the scope of the technical solution of the present invention should be covered by the claims of the present invention.

What is claimed is:

1. An electrical connector, comprising: an insulation body and a terminal group received in the insulation body, wherein the terminal group comprises upper-row terminals and lower-row terminals, a number of the upper-row terminals is equal to a number of the lower-row terminals, the upper-row terminals and the lower-row terminals are arranged in one-to-one correspondence in a vertical direction, each of the upper-row terminals is provided with an upper contacting arm extending in a horizontal direction, each of the lower-row terminals is provided with a lower contacting arm extending in the horizontal direction, wherein the upper contacting arm and the corresponding lower contacting arm partially overlap and partially stagger in the vertical direction; and an isolation plate between the upper-row terminals and lower-row terminals, wherein the isolation plate comprises a pair of upper grounding arms and a pair of lower grounding arms, the pair of upper grounding arms and the pair of lower grounding arms are integrally connected with the isolation plate, the pair of upper grounding arms and the upper-row terminals are arranged in a same plane, the pair of upper grounding arms is on two sides of the upper-row terminals respectively, the pair of lower grounding arms and the lower-row terminals are arranged in a same plane, and the pair of lower grounding arms is on two sides of the lower-row terminals respectively.

2. The electrical connector of claim 1, wherein the upper contacting arm extends in a rear-to-front direction and is provided with an upper main arm and an upper offset arm, the upper offset arm extends forwardly from a front end of the upper main arm, the lower contacting arm extends in the rear-to-front direction and is provided with a lower main arm and a lower offset arm, and the lower offset arm extends forwardly from a front end of the lower main arm.

3. The electrical connector of claim 2, wherein the upper main arm and the lower main arm are arranged in a stagger way in the vertical direction, such that a projection of the upper main arm and a projection of the lower main arm do not overlap.

4. The electrical connector of claim 3, wherein the upper offset arm extends from the front end of the upper main arm at an offset in a first direction and the lower offset arm extends from the front end of the lower main arm at an offset in a second direction opposite to the first direction, such that a projection of the upper offset arm and a projection of the lower offset arm coincide in the vertical direction.

5. The electrical connector of claim 4, wherein a front end of the upper contacting arm is provided with a bending upper embedded part, a front end of the lower contacting arm is provided with a bending lower embedded part, and the upper embedded part and the lower embedded part are embedded in the insulation body.

6. The electrical connector of claim 5, wherein the upper embedded part is provided with an upper limit arm slanted leftward, the lower embedded part is provided with a lower limit arm slanted rightward, and the upper limit arm and the lower limit arm are arranged in a stagger way in the vertical direction.

7. The electrical connector of claim 6, wherein the upper embedded part is bent downwardly from the front end of the upper contacting arm, and the lower embedded part is bent upwardly from the front end of the lower contacting arm.

8. The electrical connector of claim 1, wherein the pair of upper grounding arms is formed on the isolation plate in a tearing forming manner, two ends of each of the pair of upper grounding arms are integrally connected with the isolation plate, and the pair of lower grounding arms corresponds to the pair of upper grounding arms in the vertical direction.

* * * * *